United States Patent [19]

Hensel, Jr.

[11] 4,014,393

[45] Mar. 29, 1977

[54] CORE RECEIVER AND METHOD OF USE THEREOF

[75] Inventor: Wilber M. Hensel, Jr., Richardson, Tex.

[73] Assignee: Sun Oil Company, Dallas, Tex.

[22] Filed: Jan. 8, 1976

[21] Appl. No.: 647,476

[52] U.S. Cl. ..... 175/58; 175/250; 220/4 E; 220/239

[51] Int. Cl.[2] ..... E21B 25/00; E21B 49/02

[58] Field of Search ..... 166/250; 175/58, 4, 175/20, 239, 240, 249, 250, 320; 141/311, 346, 351, 363, 380; 220/239, 304, 4 E, 4 B; 138/93; 214/17 C, 300, 301; 193/32

[56] References Cited

UNITED STATES PATENTS

| | | | |
|---|---|---|---|
| 1,853,581 | 4/1932 | Schmissrauter et al. | 175/58 |
| 2,164,195 | 6/1939 | Waltermire | 166/187 X |
| 2,482,869 | 9/1949 | Polglase et al. | 220/4 B X |
| 2,588,957 | 3/1952 | Brown | 220/4 E |
| 2,843,154 | 7/1958 | Hosking | 220/239 X |
| 2,857,933 | 10/1958 | Lithun | 138/93 |

*Primary Examiner*—Stephen J. Novosad
*Attorney, Agent, or Firm*—J. Edward Hess; Donald R. Johnson; James H. Phillips

[57] ABSTRACT

An apparatus for coupling to the base of a vertically suspended core barrel inside a drilling rig for controllably receiving intact the columnar mass of core material contained therein. A tubular housing is provided for connecting to the barrel and includes a piston element slidably positioned therein for abutting engagement with and underlying support of the core sample to be received from the barrel. The piston element includes expandable side walls adapted for frictional engagement with the side walls of the tubular housing. Control means are provided for controlling the expansion of the piston walls, the resultant friction produced therealong and the preferred rate of movement of the core into the tubular housing under the force of gravity. The construction of the tubular housing permits the core received therein to be retained in its original extracted condition while facilitating the handling, subsequent examination and analysis thereof.

14 Claims, 4 Drawing Figures

CORE RECEIVER AND METHOD OF USE THEREOF

BACKGROUND OF THE INVENTION

The invention relates to a device for receiving and handling core material, and more particularly, to a device which will facilitate the receipt of a columnar mass of core material from a core barrel for retaining the integrity thereof.

It is generally the practice when drilling oil and gas wells to recover whole vertical sections of prospective geological formations at various depths in the drilling operation. This routine sampling is called coring and aids in determining the geological characteristics of the sub-structure. Such steps have, since the inception of deep hole drilling, been integral to proper drilling rig operations in the ultimate analysis of a particular area for oil and gas content. Consequently, coring devices have been developed for recovering columnar masses of core material from deep in the earth. The core materials are then brought to the surface for examination.

Prior art coring apparatus has included specially designed cutting heads in the form of hollow drill bits affixed to the end of elongated structures called core barrels. Conventional barrels are generally comprised of stationary inner and rotatable outer sleeves. The outer sleeves rotate with the drill pipe and rotate the drill bit. As the formation is penetrated, the "core" is fed into the inner sleeve. When a sufficient core sample has been taken and/or the inner sleeve of the barrel is full, it is raised to the surface. The core sample may be as long as 60 feet and up to 4 inches in diameter to comprise a mass weighing half a ton.

The conventional core barrel, having been withdrawn from the well, is generally suspended in the derrick above the rig floor for removal of the core. A device commonly referred to as a "core catcher," affixed to the end of the barrel, prevents the core sample from dropping out during withdrawal and while suspended in the derrick. The core catcher and the outer sleeves are removed to provide access to the core sample contained within the inner sleeve. Attention is then directed to the process of receiving the core from the barrel. It is important to recover the core intact or in a logical, orderly fashion in order to retain the characteristics of the geological structure for analysis.

Certain prior art methods and apparatus for recovering the core sample from the vertically suspended barrel include antiquated hand operated devices and less than optimal manual techniques. For example, on most conventional drilling rigs or platforms, a set of tongs is attached to the core barrel for gripping the exposed core therein. The core barrel is rested on the derrick floor. A core engineer operates the tongs and manipulates them to allow the core to controllably slide out of the barrel as it is slowly raised. With such a technique, only one to two feet are allowed to slide out at a time. The exposed length is then separated from the barrel by a rig hand who delivers a side blow to the columnar mass to break it off. This process is continued until all of the core has been recovered.

Numerous disadvantages are associated with the manual process of core recovery described above. If the core sample is well consolidated and not broken or fractured, this process may continue without incident. However, oftentimes, sections of the columnar sample are loose and/or mushy. Unconsolidated or broken sections may unexpectedly crumble off onto the rig floor. When this happens and the core cannot be retained with the tongs, the weight of the remaining core section may cause it to spew out of the barrel creating a useless and oftentimes dangerous pile of soil and rock. The core sample that is broken or crushed loses its primary value as well as causing a safety hazard on the usually wet and cramped rig floor.

It has been shown to be desirable to obtain the core sample in its entirety, and certain prior art drilling apparatus designs have been addressed to this problem. Specially designed core barrels have been made available which include means for encapsulating the core in either plastic or rubber sleeves as it is collected in the well. This approach alleviates many of the problems of recovery discussed above. However, such an apparatus, besides being more expensive than the conventional core barrel, is subject to damage by certain drilling fluids at commonly encountered elevated down hole temperatures. Moreover, usually only 20 feet of core, at generally only a 3 inch diameter, can be taken from the well at any one time, necessitating more "round trips" for a predetermined core section length.

Certain other prior art core recovery devices include means for removing the core material from the well in the exact conditions encountered inside the earth, including the pressure which existed in the area where the core was taken. Such a device is described and claimed in U.S. Pat. No. 2,248,910 issued to D. W. Auld et al on July 8, 1941. It may be readily ascertained from the efforts to develop such core recovery devices that the recovery of the core sample in its uncontaminated entirety is very important to the oil and gas industry.

It would be an advantage therefore to avoid the problems of prior art core recovery methods and apparatus by providing a device that may be attached to the outlet end of a conventional core barrel to receive the core sample in its entirety. The invention of the present core receiver is constructed just for such a purpose. The recovery technique provided therewith is much more efficient than that of the method of manually handling core sections and less expensive than the utilization of specially designed core barrels. Additionally, the conventional core barrel may be used without the usual problems of contamination and possible loss of the integrity of the core sample.

SUMMARY OF THE INVENTION

The invention relates to a device for coupling to an elongated barrel suspended generally vertically thereabove for collecting a columnar mass contained therein. More particularly, one aspect of the invention includes an elongated and movable bulkhead assembly, wherein the bulkhead comprises a supportive, braking member slidably mounted therein. The housing comprises an outer tubular shell of sufficient length to receive the columnar mass of the barrel in its entirety. The bulkhead includes means for supporting the weight of the columnar mass and for retarding its downward movement out of the containing barrel under the force of gravity.

In another aspect of the invention, the movable bulkhead comprises a piston housing having expandable side walls. Expansion is provided through inflation thereof with a pressure fluid which causes the side walls of the piston to expand into forced engagement with the side walls of the housing. A pressure fluid control system is provided for regulating the controlled expansion of the piston and resultant bulkhead support force necessary for handling the columnar mass.

In yet another aspect of the invention, the housing includes a dimidiate, or paired hemi-cylindrical, construction particularly adapted for the recovery and handling of borehole core samples. The bisected tubular construction of the housing facilitates analysis and evaluation of the recovered core sample by permitting removal of a longitudinal wall section of the housing to expose the column of mass contained therein. Coupling apparatus may be provided in such applications for attachment to the lowermost open end of the core barrel to facilitate mounting the core receiver therebeneath.

BRIEF DESCRIPTION OF THE DRAWINGS

A complete understanding of the present invention will be obtained from the following detailed description thereof when read in conjunction with the accompanying drawings, wherein.

DETAILED DESCRIPTION

Figure 1:
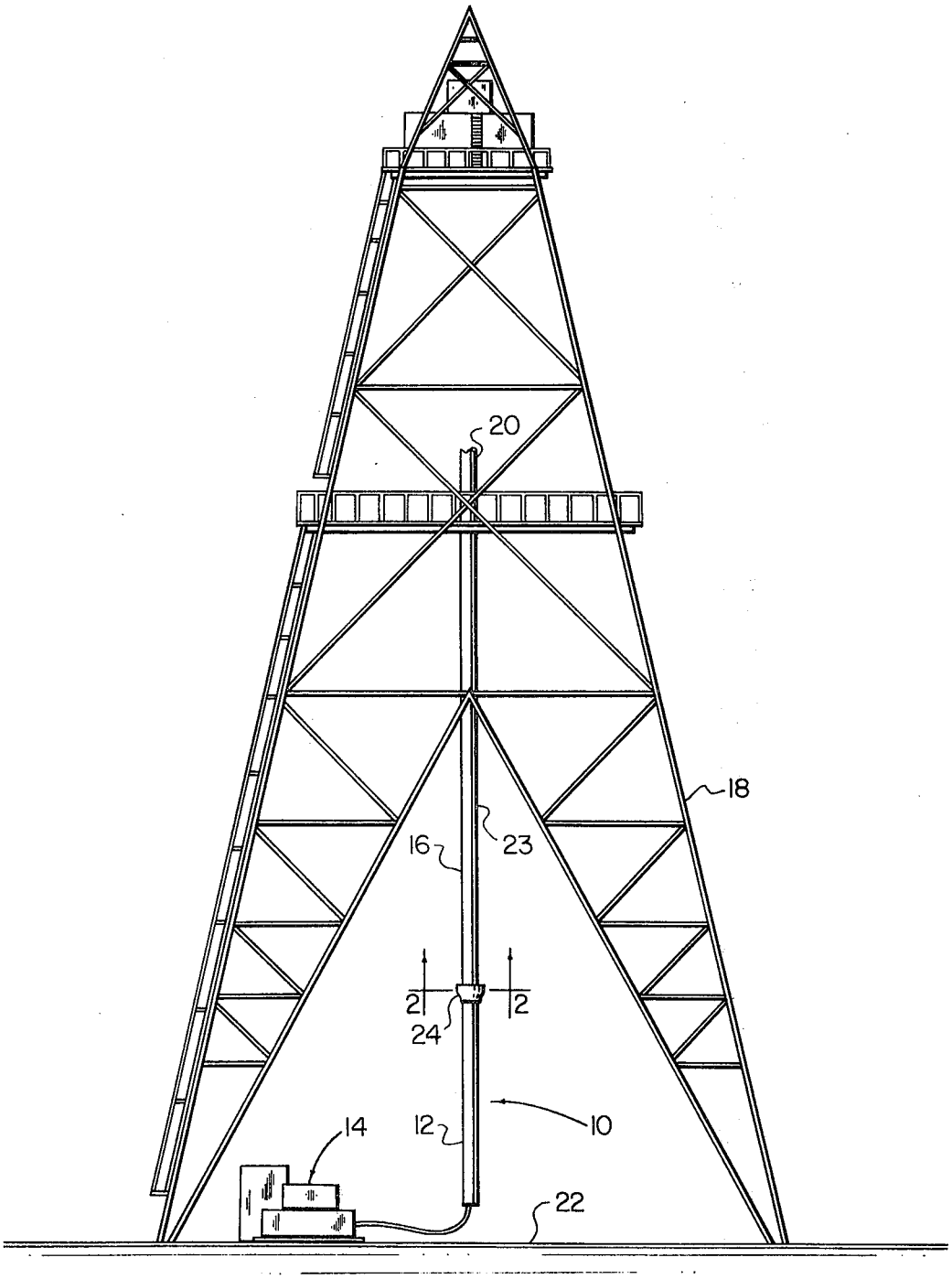
FIG. 1 is a side elevational, fragmentary view of one embodiment of a core receiver suspended within a derrick and constructed in accordance with the principles of the present invention.

Referring first to FIG. 1, there is shown a side elevational view of one embodiment of a core receiver 10 constructed in accordance with the principles of the present invention. The receiver 10 includes a tubular housing 12 and control system 14 which together may be coupled to the base of a structure containing a columnar mass of material such as a conventional core barrel 16. A drilling rig derrick 18 is shown herein for reference purposes and comprises the support structure for suspending the core barrel 16, connecting drill stem 20 and related apparatus above a drilling rig floor 22.

The conventional core barrel 16 is generally not adapted for coupling to a lower extremity as is shown. The barrel 16 is usually provided with a stationary inner sleeve 23 and an outer sleeve (not shown) which rotates with the drill stem 20. A cutting head (not shown) is generally secured to the end of the outer sleeve for cutting the core sample in the well. A device commonly referred to as a core catcher (also not shown) is generally affixed to the lower end of the sleeve 23 during the drilling operation to prevent the core sample from falling out. A substantial portion of the complexity of retreiving core sample from such conventional core barrels 16 is the removal of the core catcher. The present invention facilitates improved efficiency and safety in this procedure as well as expediting core recovery.

Figure 2:
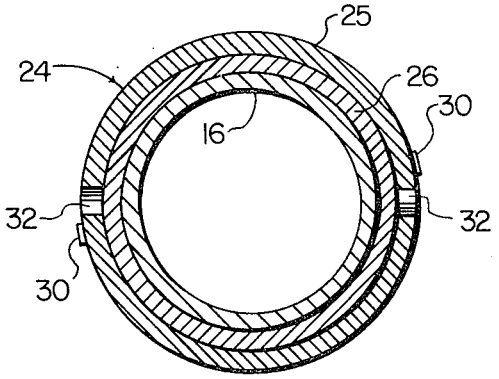
FIG. 2 is a sectional view of the core receiver of FIG. 1 taken along lines 2—2 thereof.

A coupling 24 is provided for connecting the tubular housing 12 to the lower, open end, of the core barrel 16 suspended thereabove. As mentioned above, the housing 12 is actually attached to the inner sleeve 23 of the barrel 16, but for purposes of clarity, only the barrel 16 is referred to herein. As shown most clearly in FIGS. 2 and 3, coupling 24 comprises mounting head 25 and matingly engagable mounting ring 26. The mounting ring 26 is adapted for releasably coupling to the lower end of a conventional core barrel 16 and providing means for the coupling thereto of the tubular housing 12. Suitable attachment means, such as bolts 28, are provided for engagement and securement of the ring 26 around the lower end of the barrel 16. Coupling 24 and the housing 12 are similarly constructed of suitably strong material such as steel for accommodating the enormous stresses indigenous to the drilling environment.

Figure 3:
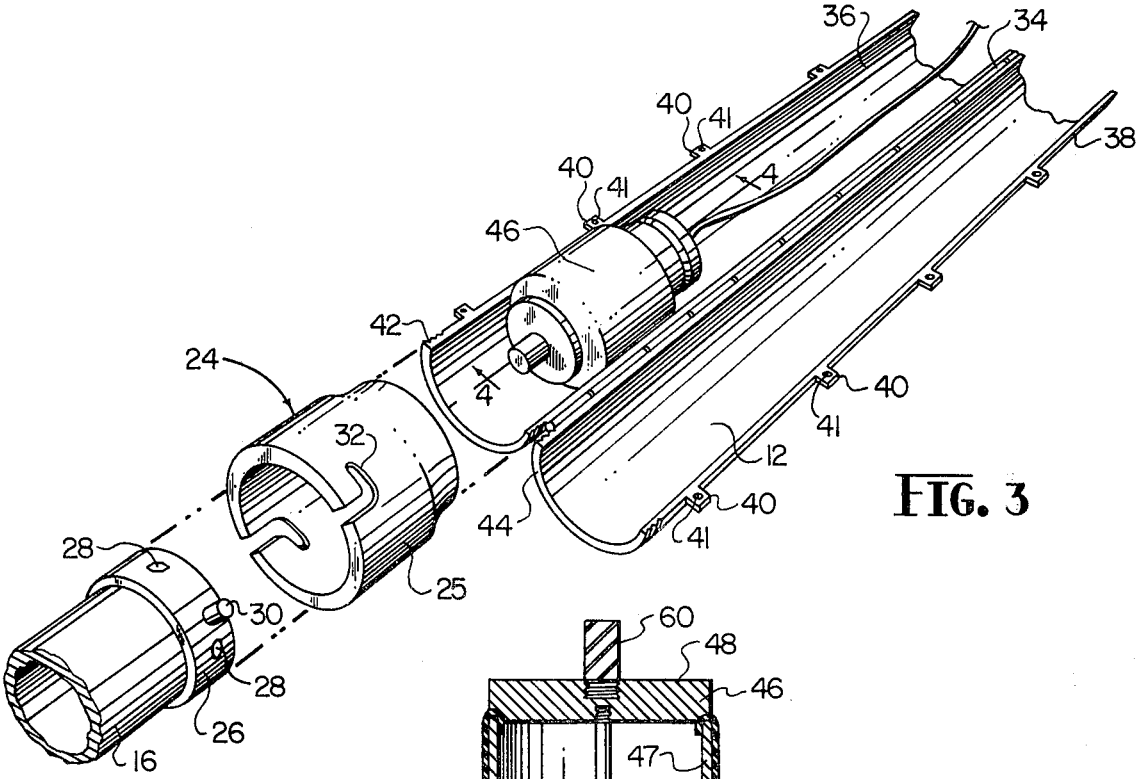
FIG. 3 is a fragmentary, exploded perspective view of the core receiver of FIG. 1 showing the details of the sliding bulkhead member therein.

Referring specifically now to FIG. 3, there is shown a mounting head 25 and ring 26 which are preferably constructed for rotatable, or twisting, interlocking engagement. The head 25 is formed for secured mounting to the upper, open end of housing 12 in a configuration for matingly receiving the ring 26. A pair of finger-like projections, or ears 30, are formed on diametrically opposite sides of the ring 26 for engaging slots 32 complementally formed in the head 25. The slots are preferably of an L-shaped configuration facilitating the axial insertion and rotational locking of the ears 30 therein. This conventional form of coupling is simple and may be effected quickly. Furthermore, the disconnection of the housing 12 from the barrel 16 is similarly facilitated, which is of great importance on the drilling rig when the housing has been filled and bears the weight of the contents of said barrel.

The housing 12 is similarly constructed to facilitate the handling of it and its contents on a drilling rig. As shown in FIG. 3, the housing 12 is of a dimidiate, or bisected, construction including two longitudinal half sections 36 and 38. The halves 36 and 38 are preferably connected by a hinge 34, or the like, along abutting sides, permitting the separation of the sections 36 and 38 for access to the contents thereof. Suitable fastening means are provided on opposite abutting sides for securing the halves together. The fastening means may include a plurality of spaced flanges 40 positioned on opposing edge sections of said halves and in registry with opposite ones thereof. Apertures 41 formed in each flange may provide for the positioning of suitable securing means such as a bolt, or the like.

The upper open end of the housing 12 is preferably formed with suitable threads 42 for affixing the mounting head 25 thereto. The top face 44 of the housing 12 is then generally axially positioned inside the head 25 for alignment, and preferably abutting engagement, with the lower end of the barrel 16. The inside diameter of the barrel 16 and tube 12 are preferably generally equivalent so that a "pig," as that term is used in the petroleum industry, in the form of a slidable bulkhead, or piston 46, may be utilized in conjunction therewith.

Figure 4:
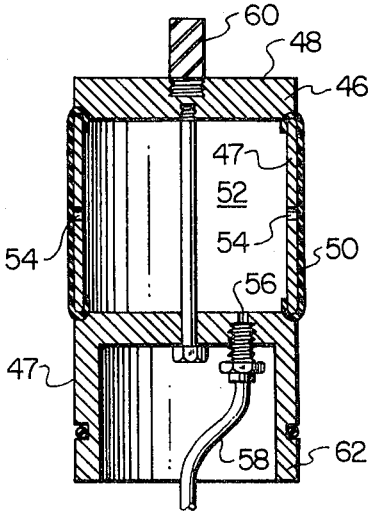
FIG. 4 is a sectional view of the bulkhead member of FIG. 3 taken along lines 4—4 thereof.

As shown most clearly in FIGS. 3 and 4, a piston 46 is provided in the present embodiment and comprises a generally cylindrical structure of mating size and shape for axial entry into and passage through the housing 12. The piston 46 includes a generally cylindrical frame structure 47, a rigid upper support head 48 and expandable side walls 50 assembled circumferentially therearound in closed communication therewith. The walls 50 are preferably formed of a suitable elastomeric material such as "Neoprene," or the like.

The piston frame 47 comprises a generally hollow structure including an upper cavity 52 communicatng through a plurality of venting ports 54 with the expandable piston walls 50. A pressure fluid port 56 constructed in the base of the frame 47 is similarly provided for the attachment of a pressure fluid line 58. Suitable pressure fluid, such as oil or air may be utilized to impart the requisite expansion of the side walls 50 circumferentially about the frame 47. Expansion of the walls 50 of the piston 46 inside the housing 12 produces increased friction between the walls of the piston and the housing which creates a braking, or resistive, force for supporting a columnar mass resting on the piston head 48 and bearing downwardly thereupon under the force of gravity.

The piston head 48 is provided with a protruding thumb element 60 extending upwardly. The thumb 60 serves as an initial contact element for abutting the lower extremity of the columnar mass collected in the barrel 16. This piston 46 is preferably specifically constructed for insertion into the base of a conventional core barrel 16, with the core catcher in place; for displacing the contents of the barrel upwardly for the underlying support of same. When the core is so displaced, the conventional core catcher can be removed from the conventional core barrel 16 in an efficient and safe manner.

The technique of introducing an axially movable bulkhead into a core barrel necessitates a bulkhead, or piston 46, structurally adapted for withstanding enormous weight. Frame 47 is thus preferably constructed of steel, or a suitably strong equivalent thereof, and includes a skirt section 62 depending from the cavity 52 and side walls 50 and comprising the supportive configuration shown. The piston 46 is adapted for placement in an upstanding position in the vicinity of, or upon, the rig floor 22 and beneath the core barrel 16, which may be lowered over the axially aligned piston 46. With the piston 46 received into the lower end of barrel 16, suitable pressure fluid may be introduced to expand the walls 50 with sufficient force to lodge said piston in said barrel. The piston 46 then temporarily plugs the barrel 16 in place of the core catcher of the barrel 16, which may then be removed. With the barrel 16 raised above the floor 22, the coupling 24 may then be attached for connection of the housing 12 in condition for receipt of the core therein, as shown in FIG. 1.

The recovery of the elongated core sample from the barrel 16 is effected by controlling the sliding and braking action of the bulkhead support member first in said barrel and then in the housing 12. Such control is effected by varying the fluid pressure supplied to the piston 46 in the system 14. The pressure in the upper chamber 52 is first decreased from the "lodging pressure" until the weight of the core starts to move in the barrel 16. The pressure is throttled through the system 14 to allow a gentle, controlled emergence of the complete core section from the barrel 16 into the tubular housing 12. When the complete core has been lowered into the housing 12, it is detached from the barrel 16 through the coupling 25. The core sample may then be handled in its entirety and laid down upon the deck 22 for immediate examination, or transported to another location for study.

The lower end of the tubular housing 12 may be sealed with the piston 46. The upper end may be similarly sealed with a suitable plug for purposes of handling. In this manner the integrity of the core may be preserved during transportation. Moreover, during examination the tubular housing 12 facilitates the exposure of its contents without affecting or contaminating same. In this manner, the core can be left intact in one of the longitudinal housing sections 36 or 38 when the other is removed for purposes of examination and sampling the core. The opened housing 12, as shown in FIG. 3, also exhibits stability upon the rig floor 22, since it cannot roll. When the core is examined at the well site, the housing 12 thus facilitates both safety and expediency while permitting the core to be suitably contained. If the core cannot roll around or break up into an unconsolidated mass or become contaminated, its usefulness cannot be accidentally destroyed.

It is believed the operation and construction of the above described invention will be apparent from the foregoing description. While the core receiver and the method of recovering core samples shown and described has been characterized as being preferred, it will be obvious that various changes and modifications may be made therein without departing from the true spirit and scope of the invention as defined in the following claims.

What is claimed is:

1. A core receiver for coupling to the end of a vertically suspended core barrel for receiving a core sample therefrom, said core receiver comprising:

an elongated receiver tube;

means for demountably coupling said receiver tube to the core barrel;

a support bulkhead slidably mounted within said tube, said bulkhead being adapted for supportive positioning of the core sample along the length of said tube; and means for controlling the position of said support bulkhead in said tube and providing adjustability in the rate of entry of the core sample into said tube from said barrel.

2. A core receiver as set forth in claim 1, wherein said support bulkhead is a piston element having outwardly expandable side walls for engaging the side walls of said tube and bearing thereagainst to produce friction therebetween.

3. A core receiver as set forth in claim 2, wherein said side walls of said piston are outwardly expandable in response to the introduction of a pressure fluid into said piston.

4. A core receiver as set forth in claim 1, wherein said receiver tube is an open ended, generally cylindrical structure adapted for general vertical positioning beneath a suspended core barrel.

5. A core receiver as set forth in claim 4, wherein said receiver tube comprises a pair of longitudinal hemicylindrical wall sections and means for securing one to the other in registry therewith.

6. A core receiver as set forth in claim 1, wherein said support bulkhead includes a piston having outwardly expandable side walls and said control means includes a pressure fluid system for outwardly expanding said side walls.

7. A core receiver as set forth in claim 1, wherein said coupling means includes a collar for securing about the lower end of said core barrel and adapted for engaging the upper end of said receiver tube for supporting said tube in general vertical positioning therebeneath.

8. A method of collecting a core sample from a core barrel suspended above a drilling rig floor in generally vertical positioning, said method comprising:

supporting the core sample in the core barrel with a slidable bulkhead positioned in the end thereof;

coupling a core receptacle beneath the barrel in general vertical alignment therewith for receiving the core sample therefrom;

allowing the bulkhead to emerge into and downwardly through the core receptacle; and disengaging the receptacle from the barrel for removal of the core sample therefrom.

9. A method of receiving a core sample from a core barrel as set forth in Claim 8, wherein the core barrel is of the type having a core catcher mounted therein and the step of supporting the core sample includes:

positioning the slidable bulkhead beneath the core barrel;

displacing the core sample upwardly by lowering the core barrel over the bulkhead and permitting the core sample to rest thereupon; and removing the core catcher from the barrel for providing egression of the core sample therefrom.

10. A method of receiving a core sample from a core barrel as set forth in claim 9 wherein, the slidable bulkhead has expandable side walls and the step of removing the core catcher includes:

imparting expansion to the slidable bulkhead to cause it to become lodged in the core barrel; and the step of allowing the bulkhead to emerge into the core receptacle includes, controlling the expansion of the side walls of the slidable bulkhead to vary its resistance to downward movement out of the core barrel and through the core receptacle under the weight of the core sample thereabove.

11. A method of removing a core catcher from a core barrel suspended above a drilling rig floor in generally vertical positioning with a core sample contained therein, said method comprising:

positioning a pig upon the floor of the rig, said pig being adapted for entry into the barrel;

lowering the barrel over the pig for receiving the pig into the end thereof;

resting the core sample on the pig;

moving the core catcher axially from and in relation to the core sample by entry of the pig into the barrel;

securing the pig in the end of the barrel in supportive positioning with the core sample; and detaching the core catcher from the barrel.

12. Apparatus for collecting a generally vertically positioned columnar mass from a containment barrel positioned therearound, comprising:

a tubular housing;

means adapting said tubular housing for coupling to the lower end of the containment barrel and receiving the contents thereof;

a slidable bulkhead adapted for positioning within said housing and the barrel for the underlying support of the mass therein; and means for controlling the position of said bulkhead in the barrel and said housing and the rate of axial movement therein for controlling the receipt of the columnar mass from the barrel into said housing.

13. The apparatus as set forth in claim 12, wherein said receptacle is a tubular housing of general rigid construction and having a dimidiate structure for affording access to the contents thereof.

14. The apparatus as set forth in claim 12, wherein said bulkhead is of a generally cylindrical construction having expandable side walls, said expansion being responsive to the introduction of a pressure fluid into said bulkhead, and said control means comprises a pressure fluid control system for controlling the expansion of said side walls of said bulkhead inside said housing.

* * * * *